US007640608B2

(12) United States Patent
Smith et al.

(10) Patent No.: US 7,640,608 B2
(45) Date of Patent: Jan. 5, 2010

(54) MEDICAL EXAMINATION TABLE

(75) Inventors: Arthur D. Smith, Greenville, OH (US); Bart L. Milbourn, Versailles, OH (US); Joseph P. Schlater, Versailles, OH (US); Leo R. Hanus, Tipp City, OH (US); Richard L. Turner, Celina, OH (US); Rainer B. Teufel, Worthington, OH (US); Jeff T. DeBord, Worthington, OH (US)

(73) Assignee: Midmark Corporation, Versailles, OH (US)

( * ) Notice: Subject to any disclaimer, the term of this patent is extended or adjusted under 35 U.S.C. 154(b) by 316 days.

(21) Appl. No.: 10/269,347

(22) Filed: Oct. 11, 2002

(65) Prior Publication Data

US 2004/0068797 A1 Apr. 15, 2004

(51) Int. Cl.
*A47C 20/04* (2006.01)

(52) U.S. Cl. ..... 5/617; 5/611

(58) Field of Classification Search ..... 5/611, 5/604, 617; 312/321.5, 322, 323, 29, 133, 312/303, 384.42, 313, 205, 311, 133.42
See application file for complete search history.

(56) References Cited

U.S. PATENT DOCUMENTS

| | | | | | |
|---|---|---|---|---|---|
| 635,962 | A | | 10/1899 | Henley | 312/273 |
| 663,179 | A | * | 12/1900 | Martine | 312/233 |
| 893,155 | A | | 7/1908 | Evans | 312/209 |
| 948,235 | A | * | 2/1910 | Melancon | 312/311 |
| 1,870,553 | A | | 8/1932 | Bullen | |
| D132,294 | S | | 5/1942 | Fay | D24/183 |
| D190,356 | S | | 5/1961 | Grant | D83/1 |
| 3,137,493 | A | | 6/1964 | Kanzelberger et al. | 269/322 |
| 3,203,670 | A | * | 8/1965 | Farris | 254/122 |
| 3,207,565 | A | * | 9/1965 | Scharge | 312/204 |
| 3,282,566 | A | | 11/1966 | Clarke | 254/122 |
| 3,290,106 | A | * | 12/1966 | Wilson et al. | 312/222 |
| D207,081 | S | | 2/1967 | Katzfey et al. | D83/1 |
| 3,334,951 | A | | 8/1967 | Douglass, Jr. et al. | 312/209 |
| 3,336,606 | A | | 8/1967 | Beitzel | 5/68 |

(Continued)

FOREIGN PATENT DOCUMENTS

| | | |
|---|---|---|
| DE | 853 498 | 10/1952 |

(Continued)

OTHER PUBLICATIONS

European Patent Office, *International Search Report,* Mailing Date Jan. 14, 2004 (3 pages).

(Continued)

*Primary Examiner*—Frederick Conley
(74) *Attorney, Agent, or Firm*—Wood, Herron & Evans, LLP

(57) ABSTRACT

A medical examination table which is movable between a lowered patient entry/exit position and a raised patient examination position. A scissor-lift assembly is provided to raise and lower the examination table. The examination table includes a drawer having a pivotal front panel which is adapted to support instruments or other items thereon when the drawer is folded to a downward position. The examination table further includes a storage pocket located beneath the backrest. The storage pocket and its contents are concealed when the backrest is lowered and are accessible when the backrest is inclined.

3 Claims, 8 Drawing Sheets

U.S. PATENT DOCUMENTS

| | | | | | |
|---|---|---|---|---|---|
| 3,348,893 | A | | 10/1967 | Katzfey et al. | 312/209 |
| 3,373,453 | A | | 3/1968 | Goodman | 5/63 |
| 3,623,707 | A | * | 11/1971 | Klopp | 254/22 |
| 3,655,179 | A | | 4/1972 | Lelugas | 269/324 |
| 3,686,696 | A | * | 8/1972 | Lanigan | 5/611 |
| D229,381 | S | | 11/1973 | Benoit et al. | D6/79 |
| 4,034,972 | A | * | 7/1977 | Peterson | 5/618 |
| 4,057,240 | A | * | 11/1977 | Damico et al. | 5/611 |
| 4,159,822 | A | | 7/1979 | Ota et al. | 269/325 |
| 4,189,197 | A | * | 2/1980 | Walker, Jr. | 312/258 |
| 4,225,127 | A | | 9/1980 | Strutton | 269/325 |
| 4,449,262 | A | | 5/1984 | Jahsman et al. | 5/63 |
| 4,451,945 | A | * | 6/1984 | Heinz et al. | 5/601 |
| 4,613,122 | A | * | 9/1986 | Manabe | 5/601 |
| 4,639,954 | A | | 2/1987 | Speed | 5/63 |
| 4,709,972 | A | | 12/1987 | LaBudde et al. | 312/208 |
| 4,768,242 | A | * | 9/1988 | LoTurco | 5/93.1 |
| 4,817,220 | A | | 4/1989 | Guttormsem | 5/63 |
| 4,894,876 | A | | 1/1990 | Fenwick | 5/60 |
| 4,984,774 | A | | 1/1991 | Zupancic et al. | 269/322 |
| 5,074,000 | A | | 12/1991 | Soltani et al. | 5/62 |
| 5,388,032 | A | | 2/1995 | Gill et al. | 364/146 |
| 5,758,933 | A | * | 6/1998 | Clendening | 312/205 |
| 6,209,463 | B1 | | 4/2001 | Koharchik et al. | 108/7 |
| 6,315,319 | B1 | | 11/2001 | Hanson et al. | 280/650 |
| 6,568,008 | B2 | * | 5/2003 | Siepmann et al. | 5/617 |

FOREIGN PATENT DOCUMENTS

| | | |
|---|---|---|
| DE | 44 15 503 A1 | 11/1995 |

OTHER PUBLICATIONS

European Patent Office, International Preliminary Examination Report, Mailing Date Jan. 25, 2005 (10 pages).

* cited by examiner

MEDICAL EXAMINATION TABLE

FIELD OF THE INVENTION

This invention relates generally to medical examination tables and, more particularly, to a medical examination table which is vertically movable between a lowered patient entry/exit position and a raised patient examination position via a motorized lift assembly.

BACKGROUND OF THE INVENTION

Medical examination tables are known to have a patient-supporting surface comprising a seat portion and an adjustable backrest portion. The backrest portion is movable between a horizontal position and an inclined position so that a patient is supported in an upright position during certain examination procedures. Motorized lift assemblies have been used with examination tables to vertically raise and lower the entire patient supporting surface of the table so that in a lowered position, a patient can enter or exit the examination table. The examination table can be vertically raised by the lift assembly to a height suitable for a particular medical examination or procedure.

One drawback with known medical examination tables is that the table's patient-supporting surface is spaced a significant distance above the floor even when the table is lowered to its lowest patient entry/exit position. When the patient supporting surface is spaced a significant distance above the floor, small children, elderly patients or disabled patients often require assistance in order to get on top of the supporting surface before the supporting surface is raised for the examination. Sometimes more than one assistant is required to lift a patient from a wheelchair to the patient supporting surface on top of the medical examination table even when the examination table is lowered to its lowest position.

Another drawback encountered with known medical examination tables is that the examination table lacks a surface on which the physician may conveniently place medical instruments needed during an examination. Typically, the examining physician must have an assistant hold a tray with all the instruments needed during an examination or the instruments are placed on a table located near the examination table. The instrument supporting table takes up valuable space in the examination room and may be accidentally jarred by the physician or assistant so that the instruments may become contaminated and/or difficult for the physician to reach when the instruments are needed.

Another drawback with known medical examination tables is that the examination tables lack sufficient storage space for rolls of paper towels and other bulky items required for the examination or for clean-up of the examination area. Such bulky items are typically stored in cabinets in the examination room but that storage space is generally limited.

Therefore, there is a need for a medical examination table that improves patient entry or exit while providing comfort to the patient during movement of the medical examination table between entry/exit and examination and treatment positions. There is also a need for a medical examination table that improves a physician's access to medical instruments and other items needed during an examination. There is yet also a need for an examination table that improves storage of bulky items required for the examination and clean-up of the examination area.

SUMMARY OF THE INVENTION

The present invention overcomes the foregoing and other shortcomings and drawbacks of medical examination tables heretofore known. While the invention will be described in connection with certain embodiments, it will be understood that the invention is not limited to these embodiments. On the contrary, the invention includes all alternatives, modifications and equivalents as may be included within the spirit and scope of the present invention.

The present invention comprises a medical examination table which is movable between a lowered patient entry/exit position and a raised patient examination position. The medical examination table of the present invention has three principal components: a base, a table assembly located above the base and a scissor-lift assembly which functions to raise and lower the table assembly relative to the base. The motorized scissor-lift assembly includes a motorized drive assembly and a scissor mechanism extending between the base and the table assembly.

The table assembly includes a generally rectangular upper frame, a seat assembly secured to the upper frame at a front thereof, and a backrest assembly secured to the upper frame at a rear end thereof. The backrest assembly includes a backrest support movable between a horizontal position and an inclined position to enable a patient to sit up while being examined. A backrest is secured to the backrest support and a seat is secured to the seat assembly. The upper surfaces of the backrest and seat provide a patient support surface which supports the patient for examination purposes.

In accordance with one aspect of the present invention, the backrest assembly includes a storage pocket adapted to house medical equipment and supplies, such as rolls of paper towels and other bulky items. The storage pocket and its contents are concealed when the backrest support and attached backrest are in their lowered position. When the backrest support and backrest attached thereto are raised, the contents of the storage pocket are easily accessed.

In accordance with another aspect of the present invention, the seat assembly includes a pull-out drawer which defines a storage area for medical instruments and other necessary accessories. The pull-out drawer has a front panel which is pivotally mounted to the drawer. The front panel is pivoted between a vertical position lying generally parallel to a front wall of the drawer and a generally horizontal position lying generally transverse to the front wall of the drawer. In its lowered or downward position, the front panel may be used as a tray to support medical instruments or other items required by a physician during an examination. When the front cover is pivoted downwardly into a generally horizontal position, it may function as a rest or support for medical instruments being used for purposes of the examination.

In accordance with yet another aspect of the present invention, a scissor-life assembly extends between the base and the upper frame of the table assembly. This scissor-lift assembly comprises two sets of legs, with the first set of legs being pivotally secured to the second set of legs. The first set of legs has forward ends which are pivotally secured to the base at fixed locations at the front of the base. These legs extend upwardly and have rear ends to which non-rotatable bearings are attached. The bearings are adapted to move in horizontally oriented slides which are fixed to the inside surfaces of the upper frame of the table assembly. Likewise, each of the second set of legs have forward ends pivotally secured at fixed locations to the front of the upper frame. The rear ends of each of the second set of legs have similar non-rotatable bearings attached thereto which are adapted to move in horizontally oriented slides which are fixed to inside surfaces of the base. When the table assembly is raised and lowered, the bearings slide inside the slides in a horizontal manner thereby causing the legs to move and the table assembly to raise or lower relative to the base.

A motorized drive assembly is used to move the table assembly upwardly and downwardly relative to the base. The drive assembly comprises a pivotal motor having a horizontally oriented output shaft connected to a gear box. The output shaft of the motor drives an actuator through the gear box. A lower end of the actuator is pivotally secured to the base and is operatively coupled to the motor which functions to rotate the actuator which is a threaded ball screw in one embodiment of the present invention. The actuator is threadably engaged with a nut and a block mounted to the nut so that rotation of the actuator causes the nut and block to travel along the length of the actuator. The block is secured to one of the sets of legs so that movement of the block by the actuator causes the table assembly to move upwardly or downwardly relative to the base.

When the table assembly is lowered, the bearings secured to the first and second sets of legs move rearwardly inside the slides attached to the base and upper frame of the table assembly. As the examination table is lowered, the actuator and its associated drive motor pivot downwardly so that the actuator and drive motor nest within an internal cavity defined by the base. In its lowermost patient entry/exit position, the patient support surface is located approximately eighteen (18) inches above the ground to provide a convenient and safe entry and exit position for the patient. In its uppermost position, the patient support surface is located approximately thirty-seven 37) inches above the ground to provide a convenient examination position of the patient for the physician.

These and other objects and advantages of the present invention will be more readily apparent from the following drawings.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE DRAWINGS

Figure 1:
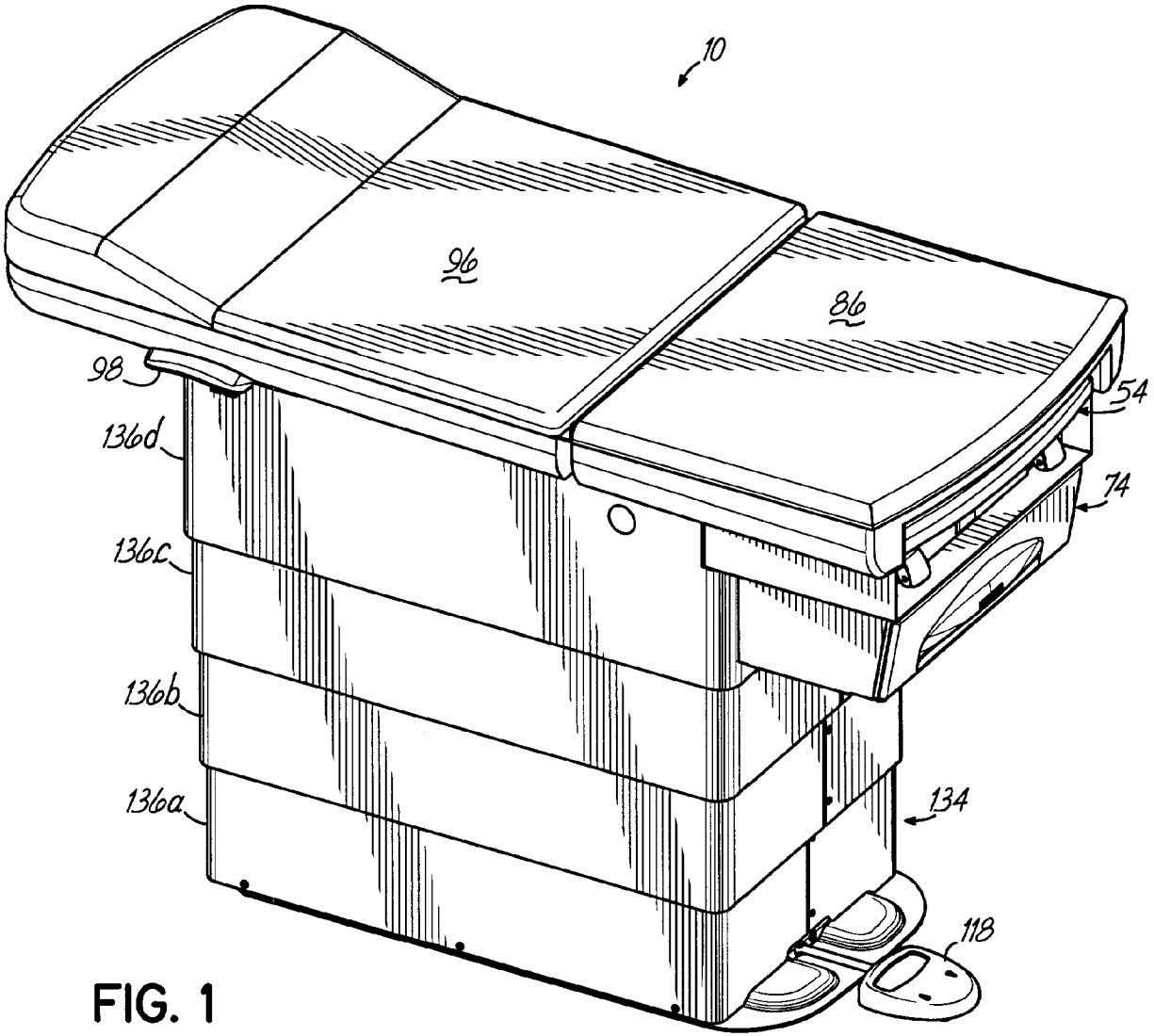
FIG. 1 is a perspective view of a medical examination table in accordance with the principles of the present invention, shown in a raised patient examination position.
Figure 1A:
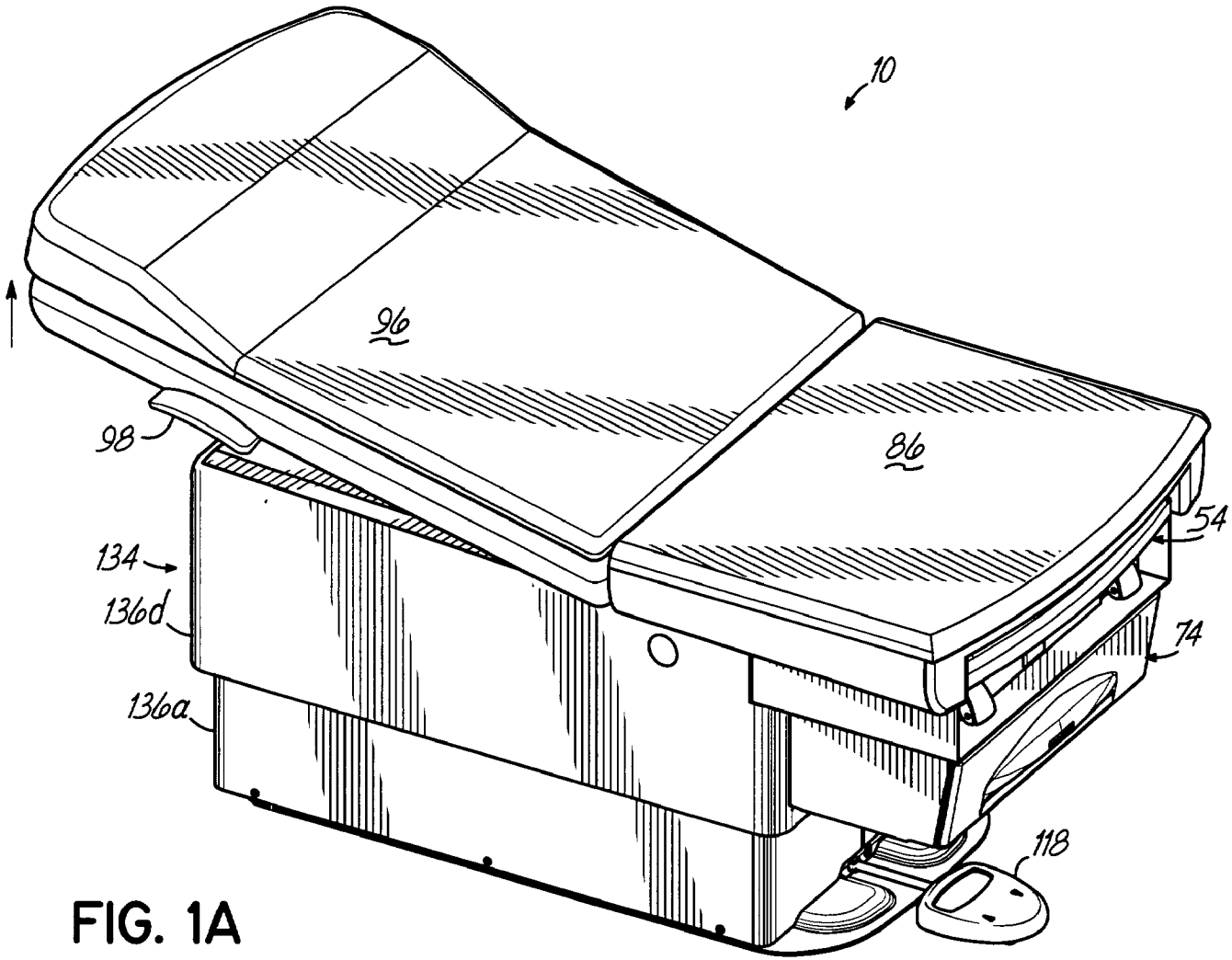
FIG. 1A is a perspective view similar to FIG. 1 illustrating the medical examination table in a lowered patient entry/exit position with the backrest slightly inclined.

Referring to the drawings, and to FIGS. 1 and 1A in particular, a medical examination table 10 in accordance with the principles of the present invention is vertically movable between a raised patient examination position, illustrated in FIG. 1, and a lowered patient entry/exit position illustrated in FIG. 1A. In its lowered position as shown in FIG. 1A, a child, elderly patient or disabled patient may be easily transported onto the table prior to the table being raised as shown in FIG. 1 for examination purposes. When the examination is over, the table may be lowered so that the patient may be easily and safely moved from the table to a wheelchair or other appropriate location.

Figure 2:
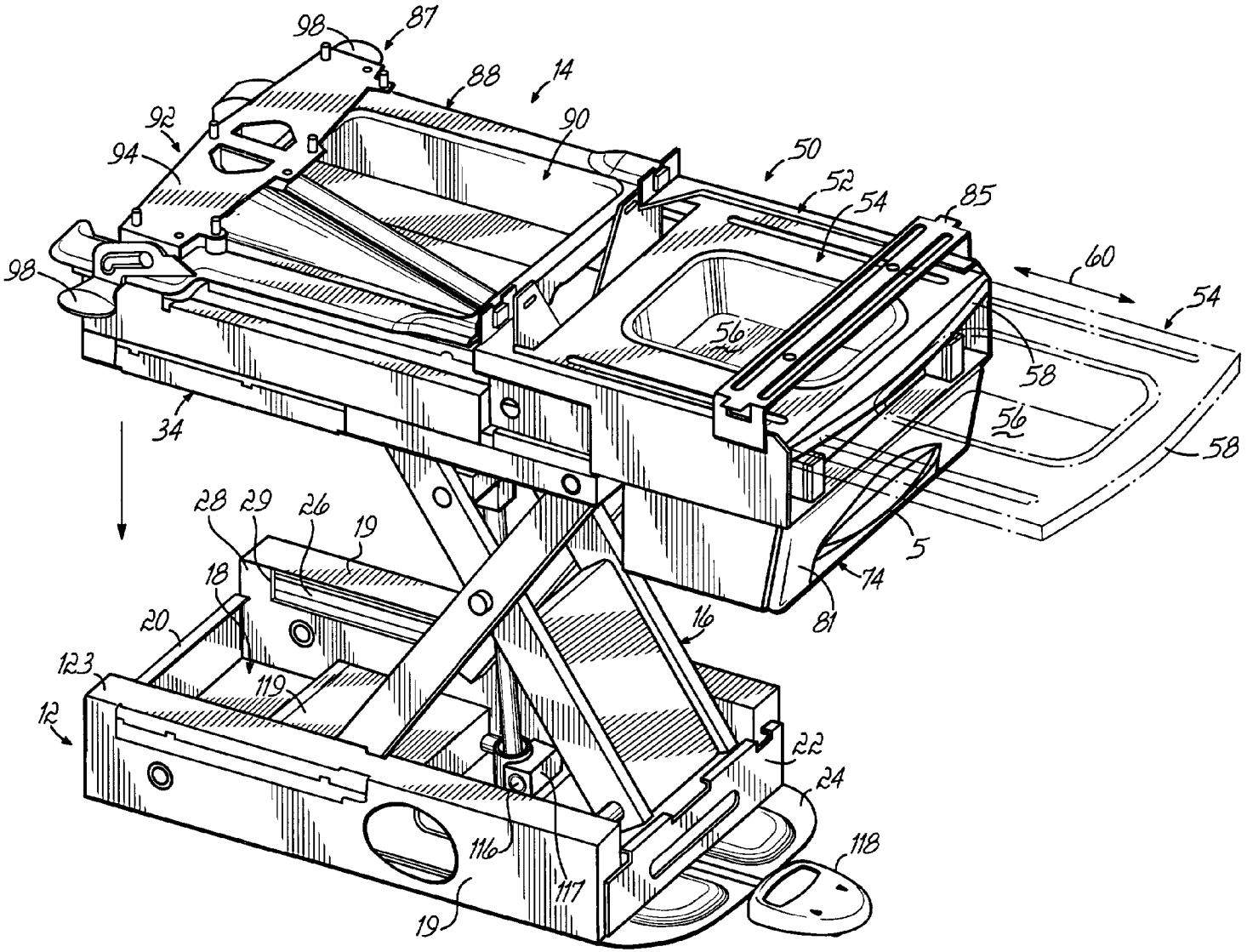
FIG. 2 is perspective view of the interior of the medical examination table with the collapsible shroud assembly, seat cushion and back rest cushion removed.
Figure 2A:
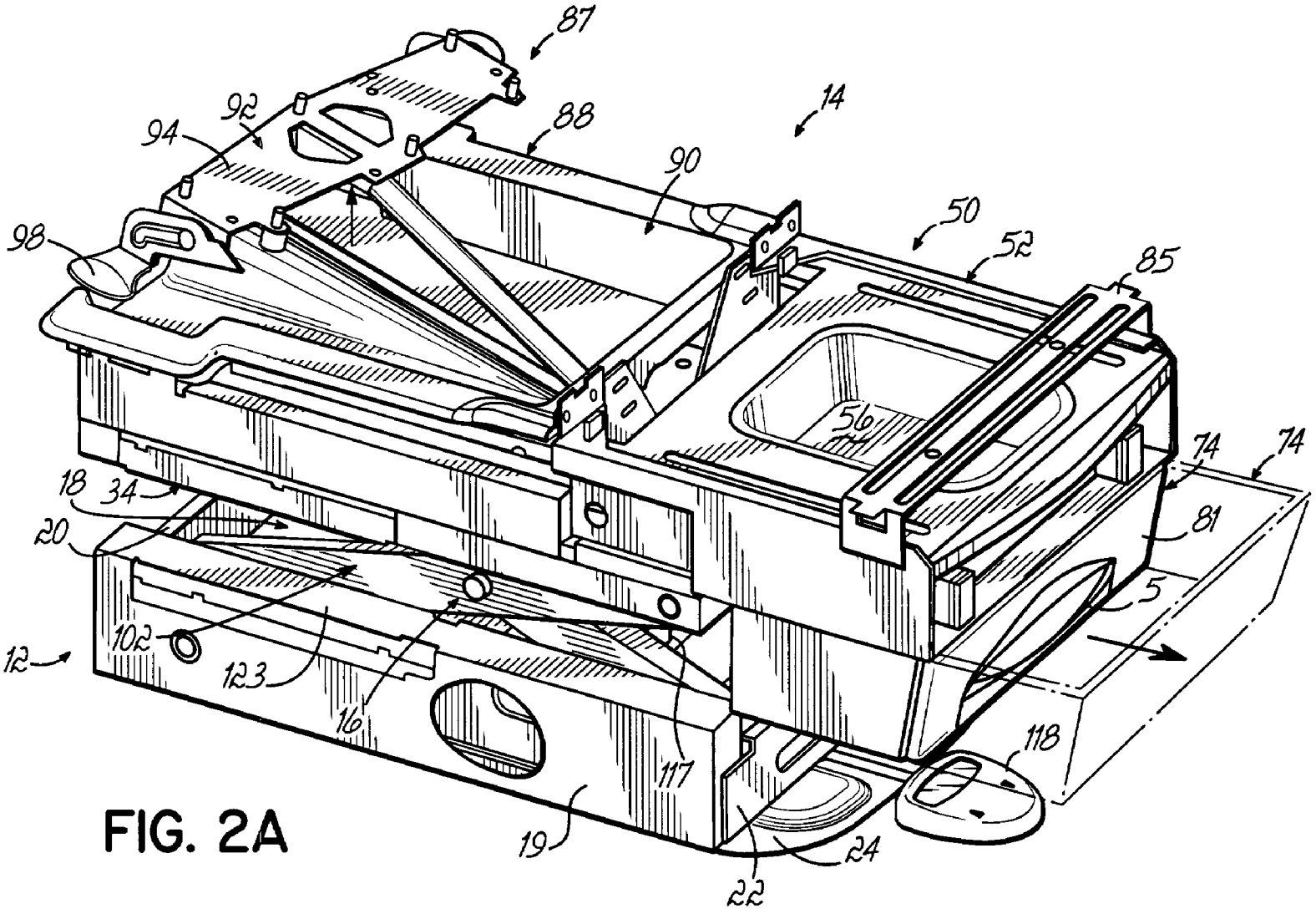
FIG. 2A is a perspective view similar to FIG. 2 illustrating the medical examination table in its lowered patient entry/exit position with the collapsible shroud assembly, seat cushion and back rest cushion removed.

As best illustrated in FIGS. 2 and 2A, the medical examination table comprises a base 12, a table assembly 14 located above the base 12, and a scissor-lift assembly 16 connected to and extending between the base 12 and the table assembly 14. The operation of the scissor-lift assembly 16 will be described in greater detail below.

The base 12 has an internal cavity 18 defined by a pair of side members 19, a rear member 20, a front member 22 and a base bottom 24. A pair of slides 26 are mounted to the side members 19 of the base 12 and are exposed through the inside surfaces 28 of the side members 19. The details of each slide 26 and its operation is described in greater detail below. Each of the slides 26 is adapted to receive and retain a non-rotatable bearing 30 (see FIGS. 5 and 8) which is part of the scissor-lift assembly 16.

Figure 5:
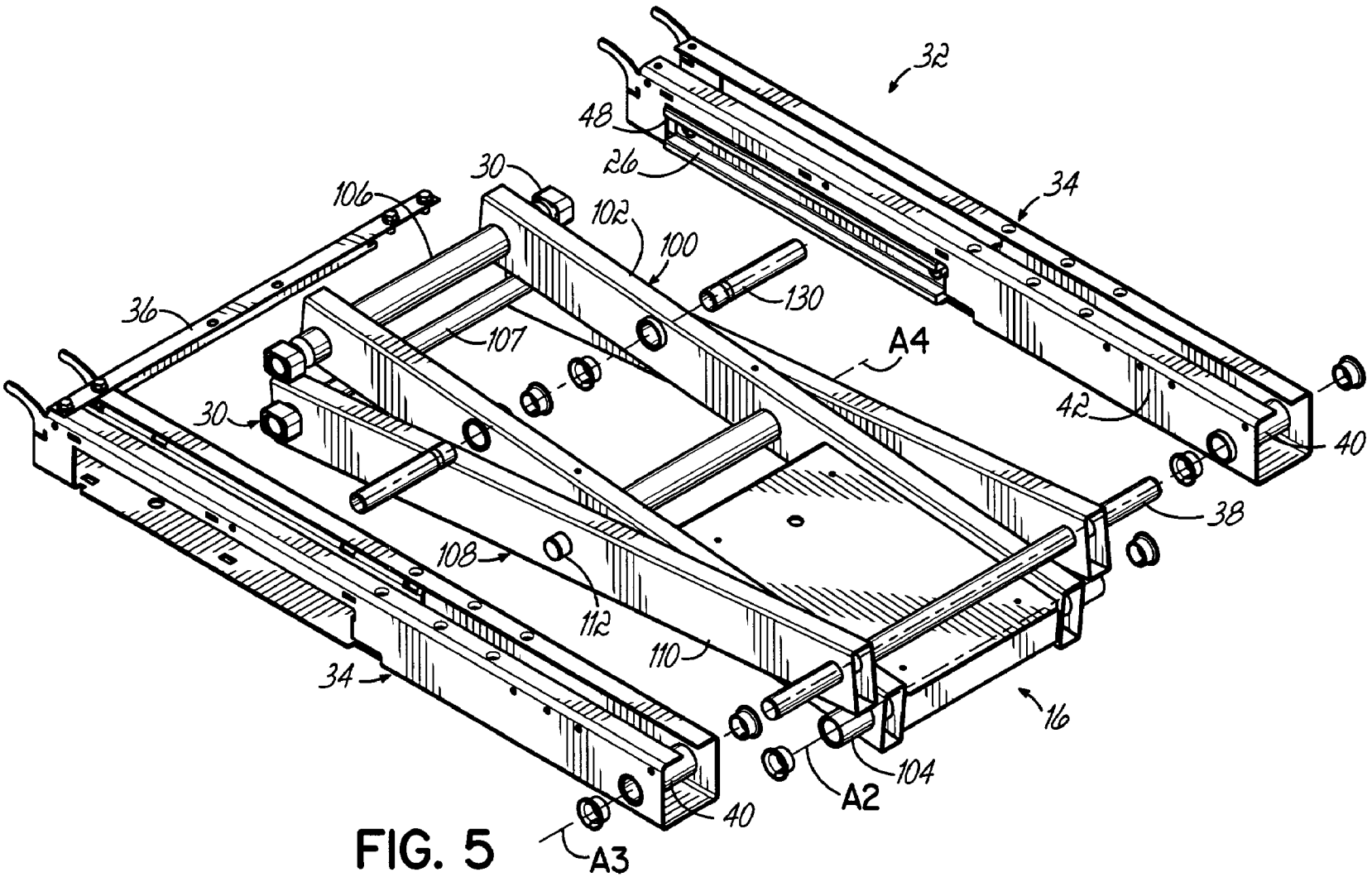
FIG. 5 is a partially disassembled view of a portion of the scissor-lift assembly of the present invention.

The table assembly 14 of the present invention is best illustrated in FIGS. 2, 2A and 5. Referring to FIG. 5, the table assembly 14 comprises an upper frame 32 which is generally rectangular in shape. The upper frame 32 comprises two side frame members 34, a rear frame member 36 secured to the side frame members 34 and extending therebetween, and a front pivot bar 38 which passes through collars 40 located in the side frame members 34. Secured to each of the side frame members 34 is a slide 26 which is exposed through the inside surface 42 of each side frame member 34. Slides 26 are adapted to receive and retain the non-rotatable bearings 30 of the scissor-lift assembly 16 as described in detail below.

Referring to FIGS. 2 and 2A, the table assembly 14 further comprises a seat assembly 50 secured to the upper frame 32 at the front thereof. The seat assembly 50 includes a housing 52 which supports a pull-out fluid collection pan 54. The pull-out fluid collection pan 54 is movable between a closed position, illustrated in FIG. 2A, and an extended position illustrated in phantom in FIG. 2. The pull-out fluid collection pan 54 has a centrally located recess or well 56 adapted to house and store fluids resulting from an examination occurring on the table 10. In order to pull out the collection pan 54, a physician grasps a front lip 58 of the collection pan 54 and pulls in the direction of arrow 60 until the collection pan 54 has been fully extended. The collection pan 54 may then be pushed inwardly to its closed position once it has been used and adequately cleaned.

Figure 3:
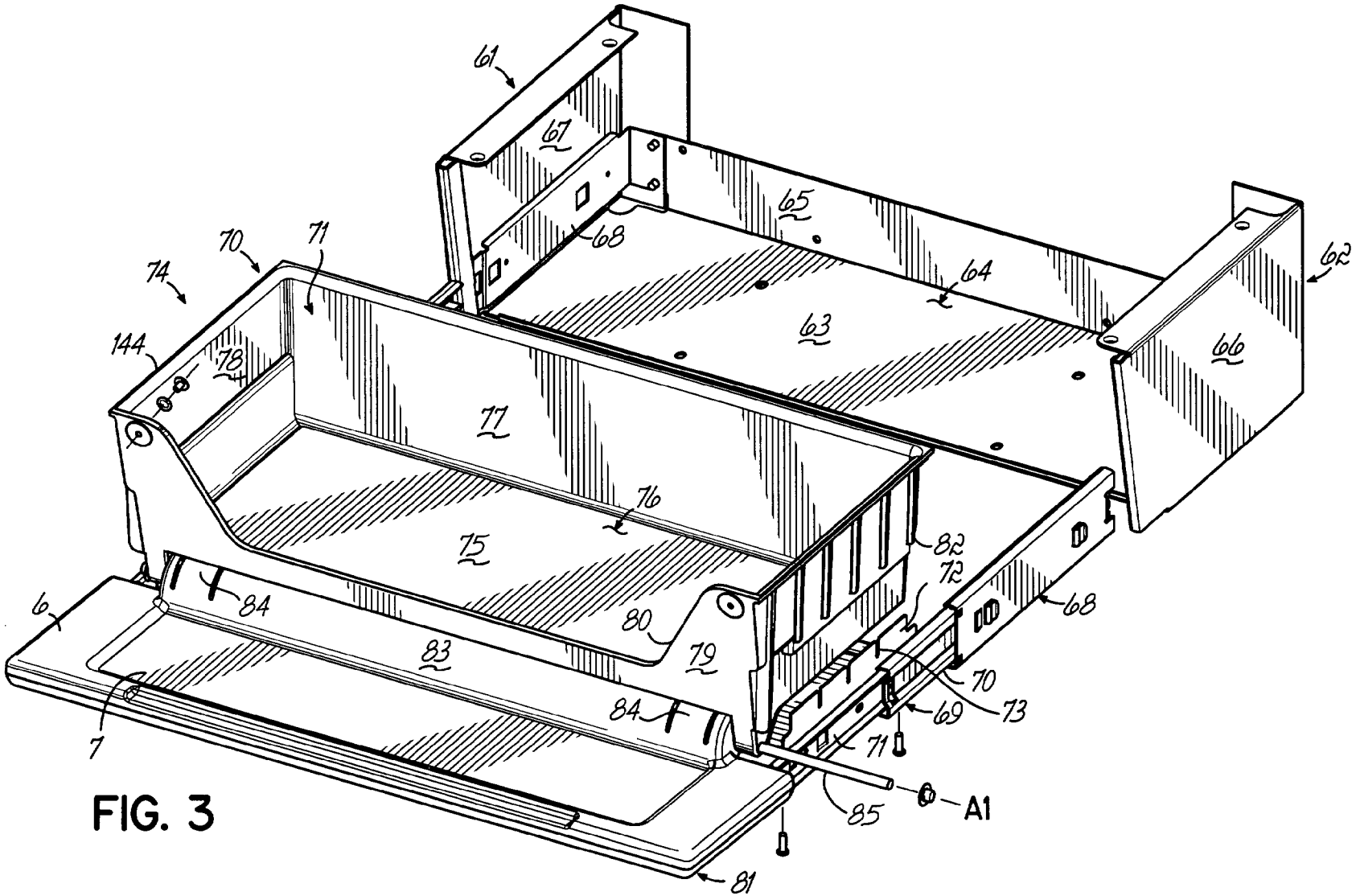
FIG. 3 is a perspective view of a pull-out drawer of the present invention having a front panel pivotally mounted thereto.

In accordance with one aspect of the present invention, the seat assembly 50 includes a pull out drawer assembly 61, illustrated in detail in FIG. 3. The drawer assembly 61 comprises a drawer housing 62 having an interior 63 defined by a housing bottom 64, a rear wall 65 and side walls 66 having inner surfaces 67 to which are secured tracks 68. Slide members 69 are mounted to slide inside the tracks 68 in a conventional manner. Each slide member 69 comprises a first section 70 and a second section 71 adapted to move inside the first section 70. Securing brackets 72 (only one being shown) are secured to the second sections 71 of the slide members 69. Each of the securing brackets 72 has a series of spaces slots 73 integrally formed therein.

A drawer 74 having an interior 75 for the storage of medical instruments and any other necessary accessories, is adapted to be removably secured to the securing brackets 72. The drawer's storage interior 75 is defined by a drawer bottom 76, a back wall 77, side walls 78, and a front wall 79 having a cutout 80 formed therein. A front panel 81 is hingedly secured to the front wall 79 of the drawer 74 in a manner described in greater detail below so that the front panel 81 is pivotal between a vertical position lying generally parallel to the front wall 79 of the drawer 74, and a horizontal position lying generally traverse to the front wall of the drawer 74 as shown in FIG. 5. The side walls 78 of the drawer 74 have a series of spaced ribs 82 adapted to be received in the slots 73 of the securing brackets 72. Thus, the drawer 74 may be lowered into a fixed position between the securing brackets 72, with the ribs 82 of the drawer 74 being engaged in the slots 73 of the securing brackets 72. When the drawer needs to be cleaned, it may be lifted vertically, with the ribs 82 of the drawer 74 being disengaged from the slots 73 of the securing brackets 72.

In a conventional manner, the drawer 74 may be pulled outwardly from a closed position illustrated in FIG. 2 to an extended position illustrated in phantom in FIG. 2A by a physician grasping a handle 5, shown in FIG. 2A, located on the front side of the front panel 81 of the drawer 74. The front panel 81 is hingedly mounted to the front wall 79 of the drawer 74 about a pin 85 which defines a horizontally-oriented pivot axis A1 about which the front panel 81 may rotate. More particularly, the front panel 81 has a circular hinge portion 83 which rotates through an opening 84 formed in the front wall 79 of the drawer 74. The front panel 81 of the drawer 74 is movable between an upward or raised position shown in FIG. 2A, in which it covers the cutout 80 formed in the drawer's front wall 79, to a downward or lowered position, illustrated in FIG. 3, in which the front panel 81 may be used as a tray to support medical instruments (not shown) or other items required by a physician during an examination procedure. The inside surface 6 of the front panel 81 has a depression 7 formed therein which aids in preventing the medical instruments (not shown) from falling off the front panel 81 when the front panel 81 is used as an instrument support tray, as shown in FIG. 3.

Further referring to FIG. 3, the hinge portion 83 of the front panel 81 includes a pair of resilient latches 84 that engage an inner surface of the front wall 79 of the drawer 74 when the front panel 81 is folded to its downward or lowered position. For safety purposes, the latches 84 are designed to disengage from the front wall 79 when a load of approximately ten (10) pounds is exerted downwardly on the front panel 81 so that the front panel 81 collapses downwardly. In this way, the latches 84 prevent the front panel 81 from being damaged in the event the front panel 81 is overloaded or stepped upon. The front panel 81 is returned to its operative position simply by reengaging the latches 84 with the front wall 79 of the drawer 74.

Referring to FIGS. 2 and 2A, another component of the seat assembly 50 of the present invention is a mounting bracket 85, which is secured to the housing 52 of the seat assembly 50. A seat 86, illustrated in FIGS. 1 and 1A, is secured to the mounting bracket 85 in conventional fashion; however, the seat 86 may be secured using other mechanisms as well without departing from the spirit of the present invention.

The table assembly 14 further comprises a backrest assembly 87, which includes a housing 88, seen best in FIGS. 2 and 2A. The backrest assembly 87 further comprises a backrest support 92, including a backrest support bracket 94 to which is secured a backrest 96. The backrest support 92 and accompanying backrest 96 are movable between a horizontal or lowered position, illustrated in FIGS. 1 and 2, and an inclined position, illustrated in FIGS. 1A and 2A. In order to raise the backrest 96, a physician simply grabs the handles 98, best illustrated in FIGS. 2 and 2A, and lifts upwardly. The backrest 96 may be locked in numerous positions using any know technology.

In accordance with another aspect of the present invention, a storage pocket 90 is centrally located in the housing 88 and is adapted to house medical equipment and supplies, including, but not limited to, rolls of paper towels and other medical instruments and cleaning supplies. In this way, the storage pocket 90 and its contents are concealed when the backrest 96 is in its lowered position. The contents of the storage pocket 90 are easily accessed by raising of the backrest 96.

Figure 6:
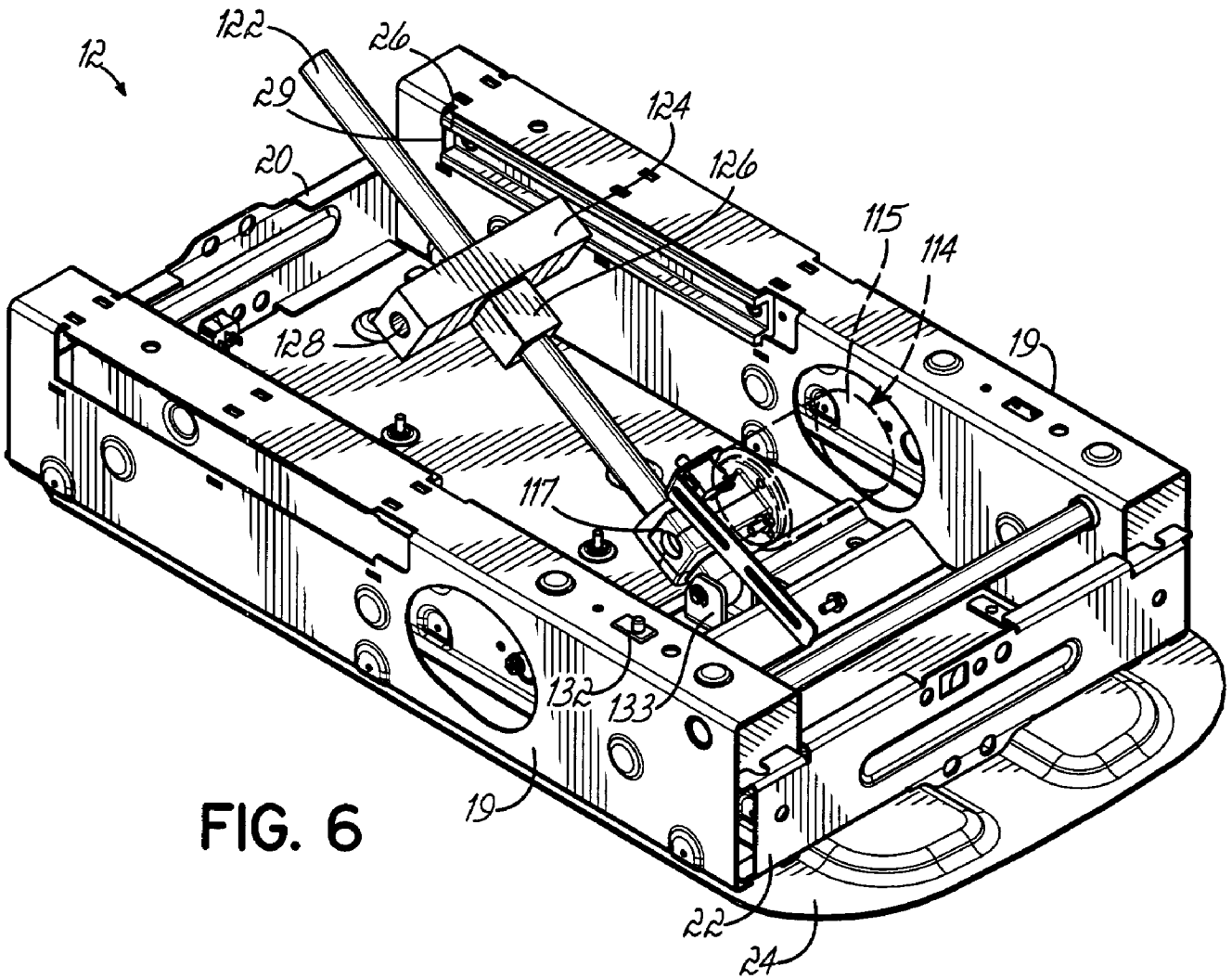
FIG. 6 is a partially disassembled view of another portion of the scissor-lift assembly of the present invention and a base of the medical examination table.

The scissor-lift assembly 16 of the present invention is best illustrated in FIGS. 5 and 6. The scissor-lift assembly 16 is secured to the upper frame 32 of the table assembly 14 and the base 16. The scissor-lift assembly 16 comprises a first set 100 of legs 102. Each of the legs 102 is pivotally secured at lower ends thereof to the base 12 about a horizontal axis A2, illustrated in FIG. 5. Tubes 104 extending outwardly from the lower ends of the legs 102 are received in the side members 19 of the base at a fixed location (see FIG. 2.). At the upper opposite ends of the legs 102 is a shaft 106 extending therebetween to which are secured the non-rotatable bearings 30 outside of the legs 102. The bearings 30 are received inside the slides 26 secured to the upper frame 32 and slide therein.

A second set 108 of legs 110 are fixedly secured to the side frame members 34 of the upper frame 32 via the front pivot bar 38. The front pivot bar 38 defines another horizontal pivot axis A3 (see FIG. 5). Additional non-rotatable bearings 30 are attached to the outer ends of a shaft 107 extending between the lower ends of the legs 110. The bearings 30 (only one being shown) attached to the shaft 107 are adapted to slide inside the slides 26 attached to the side members 19 of the base 12 (see FIG. 2.). The first set 100 of legs 102 and the second set 108 of legs 110 are pivotally connected together generally at a midpoint of the legs 102 and 110 with a shaft 112 which defines another horizontal pivot axis A4 (see FIG. 5).

FIG. 6 illustrates a drive assembly 114 of the present invention which forms part of the scissor-lift assembly 16. The drive assembly 114 comprises a pivotal motor 115 having a horizontally oriented output shaft 116 (FIG. 2) connected to a gear box 117. The motor 115 is operated by a foot pedal 118 located at the front of the base 12. Activation of the motor 115 by the foot pedal 118 rotates the motor output shaft 116 which drives an actuator 122 through the gear box 117. In one embodiment, actuator 122 is a threaded ball screw but may assume other configurations as well without departing from the spirit and scope of the present invention. The lower end of the actuator 122 is pivotally mounted to a bracket 133 (FIG. 6) mounted to the base 12. The foot pedal 118 is electrically coupled to a control box 119 located in the base cavity 18 (see FIG. 2). A nut 126 (FIG. 6) is threaded to the ball screw actuator 122 so that the nut 126 and a block 124 mounted to the nut 126 are driven by the actuator 122 between raised and lowered positions. The block 124 has a pair of passageways 128 therethrough which are adapted to receive shafts 130 of the scissor-lift assembly 16 as shown in FIG. 5 so that the block 124 is secured to the second set 100 of legs 102.

Figure 7:
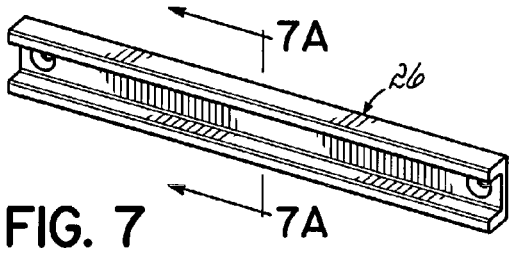
FIG. 7 is a perspective view of a scissor-lift leg slide of the present invention.
Figure 7A:
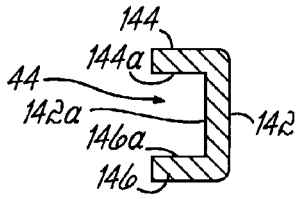
FIG. 7A is a cross-sectional view taken along the line 7A-7A of FIG. 7.

FIGS. 7 and 7A illustrate one of the slides 26 of the present invention. Each slide 26 has a web portion 142, an upper flange portion 144 and a lower flange portion 146. The upper and lower flange portions 144, 146 each have an inside surface 144*a* and 146*b*, respectively, which are parallel to one another. The web portion 142 has an inside surface 142*a*. The inside surfaces 144*a*, 146*b* and 142*a* define a track 44 of the slide 26 inside which rides one of the non-rotatable bearings 30. The slides 26 are preferably made of aluminum but may be made of any material.

Figure 8:
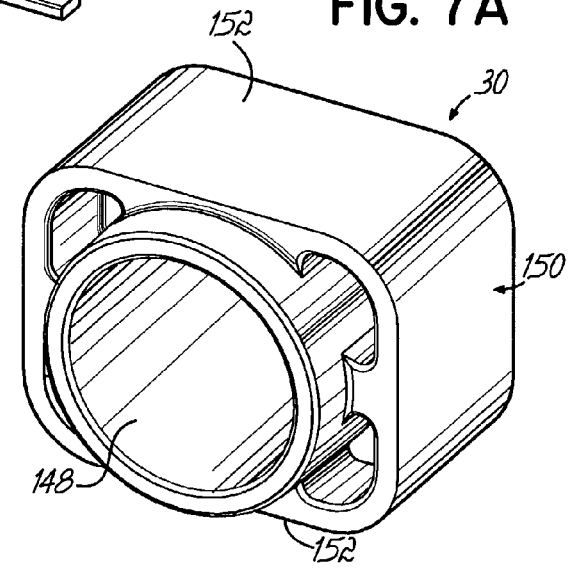
FIG. 8 is a perspective view of a scissor-lift leg bearing of the present invention.

FIG. 8 illustrates one of the non-rotatable bearings 30. Each of the bearings 30 has a circular recess 148 adapted to receive and retain one end of one of the shafts 106, 107. Each bearing 30 has a rectangular outer portion 150 having outer surfaces 152. The two opposed upper and lower outer surfaces 152 define a height distance which is approximately equal to the height distance between the inside surfaces 144A and 146A of the upper and lower flange portions 144, 146 of each slide 26. Thus, each bearing 30 is able to travel inside the track 44 of the slide 26 in a non-rotatable manner, and the approximately equal height of the bearings 30 and the inside height of the tracks 44 creates a very tight clearance to accommodate the tension and compression forces exerted by the legs 102 and 110. The bearings 30 are made of plastic, in particular, Polymer Blend 15, a plastic commercially available from Performance Plastics, Incorporated, 435 Brownway Avenue, Cincinnati, Ohio 45209.

In operation, when the foot pedal 118 is depressed to lower the examination table 10, the motor 116 is actuated causing the actuator 122 to rotate. Thus, the nut 126 and block 124 are driven downwardly, causing the bearings 30 to ride rearwardly inside the slides 26 attached along the actuator 122 to the base 12 and upper frame 32, and the upper frame 32 to move downwardly until it rests upon an upper surface 123 of the side members 19 of the base 12. At this point, the upper frame 32 actuates switches 132 (FIG. 6) stopping the motor. As the examination table 10 is lowered, the actuator 122 and its associated drive motor 115 pivot downwardly about the pivotal connection of the actuator 122 to the bracket 133. The actuator 122 and motor 115 rest within the internal cavity 18 of the base 12 when the examination table 10 is moved to the patient entry/exit position shown in FIGS. 1A and 2A. In its lowermost position, the patient support surface is located approximately eighteen (18) inches above the ground to provide a convenient and safe entry and exit position for the patient.

To raise the table assembly 14, the foot pedal 118 is depressed to actuate the motor 115. This causes the actuator 122 to rotate in the opposite direction, thereby moving the nut 126 and block 124 upwardly and causing the bearings 30 to move forwardly in the slides 26. Eventually the nut 126 and block 124 will not go any higher on the actuator 122, at which point the motor 115 is stopped. As the examination table is raised to a patient examination position, the actuator 122 and motor 115 pivot upwardly as shown in FIG. 2. In its uppermost position, the patient support surface is located approximately thirty-seven (37) inches above the ground to provide a convenient examination position of the patient for the physician.

Figure 4:
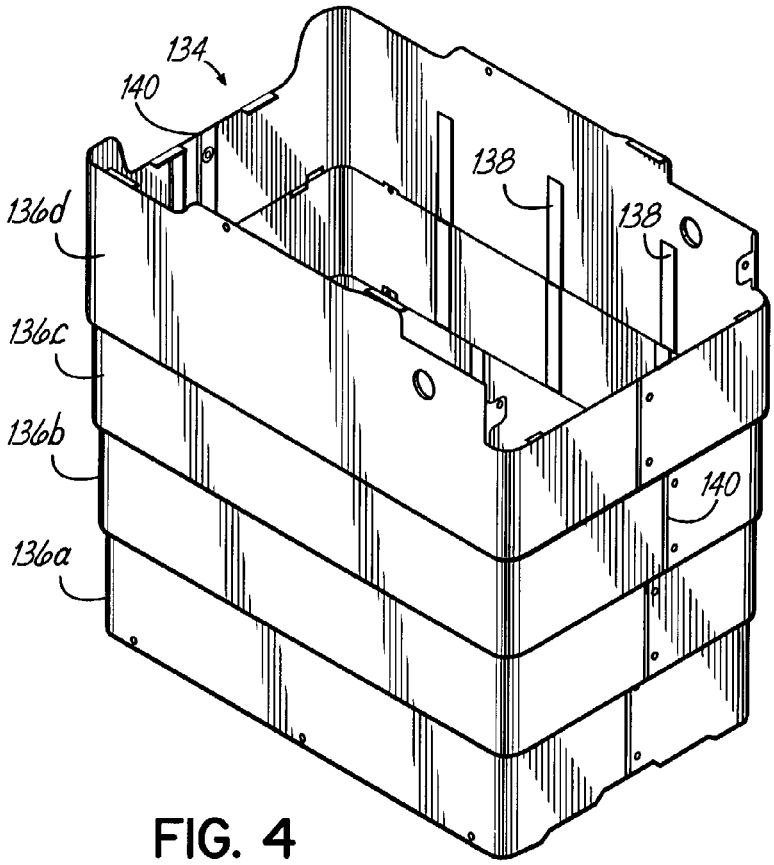
FIG. 4 is a perspective view of the shroud assembly of the present invention.

As best illustrated in FIGS. 1 and 4, the scissor-lift assembly 16 is covered by a shroud assembly 134, comprising multiple shroud pieces 136A-D, each being nestable inside the shroud piece directly above it. Although four shroud pieces are illustrated and described, any number of shroud pieces may be used in accordance with the present invention. Shroud piece 136*a* is fixedly secured to the base 12 and shroud piece 136*d* is fixedly secured to the upper frame 32. The middle shroud pieces 136*b*, 136*c* float between the upper and lower shroud pieces 136*d* and 136*a*, respectively.

Each of the shroud pieces has at least one bearing strip 138 (FIG. 4), such as a VELCRO strip, which facilitates movement of the shroud pieces relative to one another. In addition, each of the shroud pieces 136*a-d* has joint 140. The joints 140 of adjacent shroud pieces are offset relative to each other so as to not interfere with the movement and nestability of the shroud piece 136 and of the shroud assembly 134.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicants' general inventive concept.

Having described the invention, what is claimed is:

1. A medical examination table comprising:

a base;

a table assembly supported above said base, said table assembly including a storage pocket adapted to store items therein;

a backrest supported by said table assembly and movable between a horizontal position and an inclined position, said storage pocket being concealed when said backrest is in said horizontal position and accessible when said backrest is in said inclined position; and a lift assembly extending between said base and said table assembly for vertically lifting and lowering said table assembly relative to said base, said lift assembly including a motorized drive assembly having a horizontally oriented motor and a rotatable actuator driven by said motor for vertically lifting and lowering said table assembly relative to said base, each of said motor and said actuator being pivotal upwardly and downwardly about a pivot point relative to said base with said motor being mounted in spaced relationship from said pivot point and said motor maintaining its horizontal orientation as said table assembly is vertically lifted and lowered relative to said base.

2. A medical examination table comprising:

a base;

an upper frame spaced above said base;

a scissor-lift assembly secured to said base and said upper frame for vertically lifting and lowering said upper frame relative to said base, said scissor-lift assembly comprising a first set of legs pivotally secured to a second set of legs, said first set of legs having respective ends pivotally secured to said base at fixed locations and said second set of legs having respective ends pivotally secured to said upper frame at fixed locations;

bearings provided at respective ends of said first and second sets of legs, said bearings being adapted to move in horizontally oriented slides supported by said upper frame and said base; and a drive assembly including a horizontally oriented motor and a rotatable actuator driven by said motor, said rotatable actuator being operatively coupled to said first and second sets of legs for raising and lowering said upper frame relative to said base in response to operation of said motor, each of said motor and said actuator being pivotal upwardly and downwardly about a pivot point relative to said base with said motor being mounted in spaced relationship from said pivot point and said motor maintaining its horizontal orientation as said upper frame is vertically lifted and lowered relative to said base.

3. A medical examination table comprising:

a base;

an upper frame spaced above said base;

a scissor-lift assembly secured to said base and said upper frame for vertically lifting and lowering said upper frame relative to said base, said scissor-lift assembly comprising a first set of legs pivotally secured to a second set of legs, said first set of legs having respective ends pivotally secured to said base at fixed locations and said second set of legs having respective ends pivotally secured to said upper frame at fixed locations;

bearings provided at respective ends of said first and second sets of legs, said bearings being adapted to move in horizontally oriented slides supported by said upper frame and said base; and a drive assembly including a horizontally oriented motor and an actuator driven by said motor, said actuator being operatively coupled to said first and second sets of legs for raising and lowering said upper frame relative to said base in response to operation of said motor, said motor nesting entirely within said base when said upper frame is lowered to its lowermost position, each of said motor and said actuator being pivotal upwardly and downwardly about a pivot point relative to said base with said motor being mounted in spaced relationship from said pivot point and said motor maintaining its horizontal orientation as said upper frame is vertically lifted and lowered relative to said base.

* * * * *

UNITED STATES PATENT AND TRADEMARK OFFICE

CERTIFICATE OF CORRECTION

PATENT NO. : 7,640,608 B2
APPLICATION NO. : 10/269347
DATED : January 5, 2010
INVENTOR(S) : Arthur D. Smith It is certified that error appears in the above-identified patent and that said Letters Patent is hereby corrected as shown below:

Title Page, References Cited, FOREIGN PATENT DOCUMENTS, add --EPO, 0 191 013, 08/1986--, as shown in the non-final Office Action, mailed July 1, 2005, Form PTO-892 (Rev. 01-2001) under Foreign Patent Documents.

In column 2, line 58, change "scissor-life assembly" to --scissor-lift assembly--.

Signed and Sealed this

First Day of June, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,640,608 B2
APPLICATION NO. : 10/269347
DATED : January 5, 2010
INVENTOR(S) : Smith et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 456 days.

Signed and Sealed this

Sixteenth Day of November, 2010

David J. Kappos

David J. Kappos
*Director of the United States Patent and Trademark Office*